US008925343B1

(12) United States Patent
Flores

(10) Patent No.: US 8,925,343 B1
(45) Date of Patent: Jan. 6, 2015

(54) ICE STORAGE BUCKET FOR REFRIGERATOR

(75) Inventor: Laura Esther Flores, Nuevo Leon (MX)

(73) Assignee: Whirlpool Corporation, Benton Harbor, MI (US)

( * ) Notice: Subject to any disclaimer, the term of this patent is extended or adjusted under 35 U.S.C. 154(b) by 289 days.

(21) Appl. No.: 12/768,984

(22) Filed: Apr. 28, 2010

(51) Int. Cl.
*F25D 25/00* (2006.01)
*F25C 5/18* (2006.01)

(52) U.S. Cl.
USPC ..... 62/377; 62/344

(58) Field of Classification Search
USPC ..... 62/377, 337, 344, 459, 382
See application file for complete search history.

(56) References Cited

U.S. PATENT DOCUMENTS

| | | | | |
|---|---|---|---|---|
| 2,694,906 | A * | 11/1954 | Didion | 62/326 |
| 2,717,505 | A | 9/1955 | Andersson | |
| 2,801,146 | A * | 7/1957 | Mikulas | 312/301 |
| 2,898,173 | A * | 8/1959 | Squire | 312/248 |
| 4,186,978 | A * | 2/1980 | Thomson | 312/321.5 |
| 4,333,588 | A * | 6/1982 | Schreck et al. | 222/164 |
| 4,790,146 | A | 12/1988 | Mun et al. | |
| 5,040,856 | A * | 8/1991 | Wilkins et al. | 312/402 |
| 5,385,378 | A | 1/1995 | Hakamada et al. | |
| 6,076,878 | A | 6/2000 | Isano | |
| 6,085,542 | A | 7/2000 | Johnson et al. | |
| 6,425,259 | B2 | 7/2002 | Nelson et al. | |
| 6,442,954 | B1 | 9/2002 | Shapiro et al. | |
| 6,742,855 | B2 * | 6/2004 | Whitaker et al. | 312/405.1 |
| 6,952,936 | B2 | 10/2005 | Sannasi et al. | |
| 7,070,249 | B2 * | 7/2006 | Leimkuehler et al. | 312/405.1 |
| 7,188,479 | B2 * | 3/2007 | Anselmino et al. | 62/66 |
| 7,228,703 | B2 | 6/2007 | Kim et al. | |
| 7,266,972 | B2 | 9/2007 | Anselmino et al. | |
| 7,284,390 | B2 | 10/2007 | Van Meter et al. | |
| 7,337,617 | B2 | 3/2008 | Anderson | |
| 7,467,834 | B2 * | 12/2008 | Kim et al. | 312/402 |
| 7,469,553 | B2 * | 12/2008 | Wu et al. | 62/344 |
| 7,469,980 | B2 * | 12/2008 | Koo | 312/405.1 |
| 7,591,141 | B2 | 9/2009 | Wetekamp et al. | |
| 7,870,754 | B2 | 1/2011 | Martin et al. | |
| 8,117,863 | B2 | 2/2012 | Van Meter et al. | |
| 2001/0052741 | A1 * | 12/2001 | Yun | 312/405 |
| 2004/0035129 | A1 * | 2/2004 | Kaiser | 62/302 |
| 2007/0113578 | A1 | 5/2007 | Wu et al. | |
| 2010/0077789 | A1 * | 4/2010 | Lim et al. | 62/344 |

FOREIGN PATENT DOCUMENTS

| | | | | |
|---|---|---|---|---|
| WO | WO2008084940 | A1 * | 7/2008 | F25C 5/18 |
| WO | WO 2009072794 | A2 * | 6/2009 | F25C 1/04 |

* cited by examiner

*Primary Examiner* — Janet M Wilkens
*Assistant Examiner* — Andrew Roersma

(57) ABSTRACT

A refrigerator includes a refrigerator housing and at least one compartment displaced within the refrigeration housing. There is a door for providing access to one or more of the at least one compartments. There is an ice storage bucket placed beneath an ice making unit for collecting and storing ice. The ice storage bucket includes an open top end and an opposite bottom surface. A first and a second cylindrical protrusion are positioned proximate the bottom surface of the ice storage bucket. There is a mounting plate beneath the ice storage bucket, the mounting plate operatively connected to the door. The first and the second cylindrical protrusions assist in fixation and rotation of the ice storage bucket relative to the mounting plate.

8 Claims, 8 Drawing Sheets

ICE STORAGE BUCKET FOR REFRIGERATOR

FIELD OF THE INVENTION

The present invention relates to refrigerators. More particularly, but not exclusively, the present invention relates to an ice storage bucket for a refrigerator.

BACKGROUND OF THE INVENTION

Refrigerators frequently provide for making and storing ice. However, some times it may be inconvenient for users to access stored ice. This is particularly the case where ice is stored in the fresh food compartment door. Typically, additional insulation of the door would be needed if ice is to be stored at the door, which can make it even more inconvenient for a user to access an ice bin or ice storage bucket. Once the ice bin or ice storage bucket is accessed by a user, the user may need to completely remove the ice storage bucket in order to remove ice. This may be inconvenient. What is needed is an ice storage bucket that allows ice to be stored and is conveniently accessible for users.

BRIEF SUMMARY OF THE INVENTION

Therefore, it is a primary object, feature or advantage of the present invention to improve over the state of the art.

It is a further object, feature, or advantage of the present invention to provide an ice storage system that is suitable for use on the door of a refrigerator.

Yet another object, feature, or advantage of the present invention is to provide an ice storage bucket for a refrigerator that allows a user to conveniently access and remove ice.

It is a further object, feature, or advantage of the present invention to provide an ice storage bucket for a refrigerator that is both removable and tiltable.

A still further object, feature, or advantage of the present invention is to provide an ice storage bucket suitable for use on the fresh food compartment door.

One or more of these and/or other objects, features, or advantages of the present invention will become apparent from the specification and claims that follow. No single embodiment of the present invention need achieve each and every one of these objects, features, and advantages.

According to one aspect of the present invention, a refrigerator is provided. The refrigerator includes a refrigerator housing and at least one compartment displaced within the refrigeration housing. There is a door for providing access to one or more of the at least one compartments. There is an ice storage bucket placed beneath an ice making unit for collecting and storing ice. The ice storage bucket includes an open top end and an opposite bottom surface. A first and a second cylindrical protrusion are positioned proximate the bottom surface of the ice storage bucket. There is a mounting plate beneath the ice storage bucket, the mounting plate operatively connected to the door. The first and the second cylindrical protrusions assist in fixation and rotation of the ice storage bucket relative to the mounting plate.

According to another aspect of the present invention, an ice storage bucket is provided. The ice storage bucket body has an open top end and an opposite bottom surface and sidewalls extending between the open top end to the bottom surface. A first and a second protrusion are located proximate the bottom surface to assist in fixation and rotation of the ice storage bucket and are configured for mating with a first and a second hemispherical indentation of a mounting plate at a refrigerator door.

According to another aspect of the present invention, a refrigerator is provided. The refrigerator includes a refrigerator housing, a fresh food compartment disposed within the housing, a freezer compartment disposed within the housing, and a fresh food compartment door for providing access to the fresh food compartment. There is a mounting plate at the fresh food compartment door. There is an ice storage bucket for collecting and storing ice. The ice storage bucket includes an open top end and an opposite bottom surface. A first and a second cylindrical protrusion are positioned proximate the bottom surface of the ice storage bucket. A first and a second guide member are positioned in the mounting plate and are configured to receive the first and the second cylindrical protrusions. There may be a first and a second hemispherical indentation associated with the first and the second guide members of the mounting plate for mating with the first and the second hemispherical protrusions. The first and the second cylindrical protrusions assist in fixation and rotation of the ice storage bucket relative to the mounting plate.

Other aspects, features and details of the present invention can be more completely understood by reference to the following detailed description in conjunction with the drawings, and from the appended claims.

DETAILED DESCRIPTION OF THE PREFERRED EMBODIMENT

Figure 1:
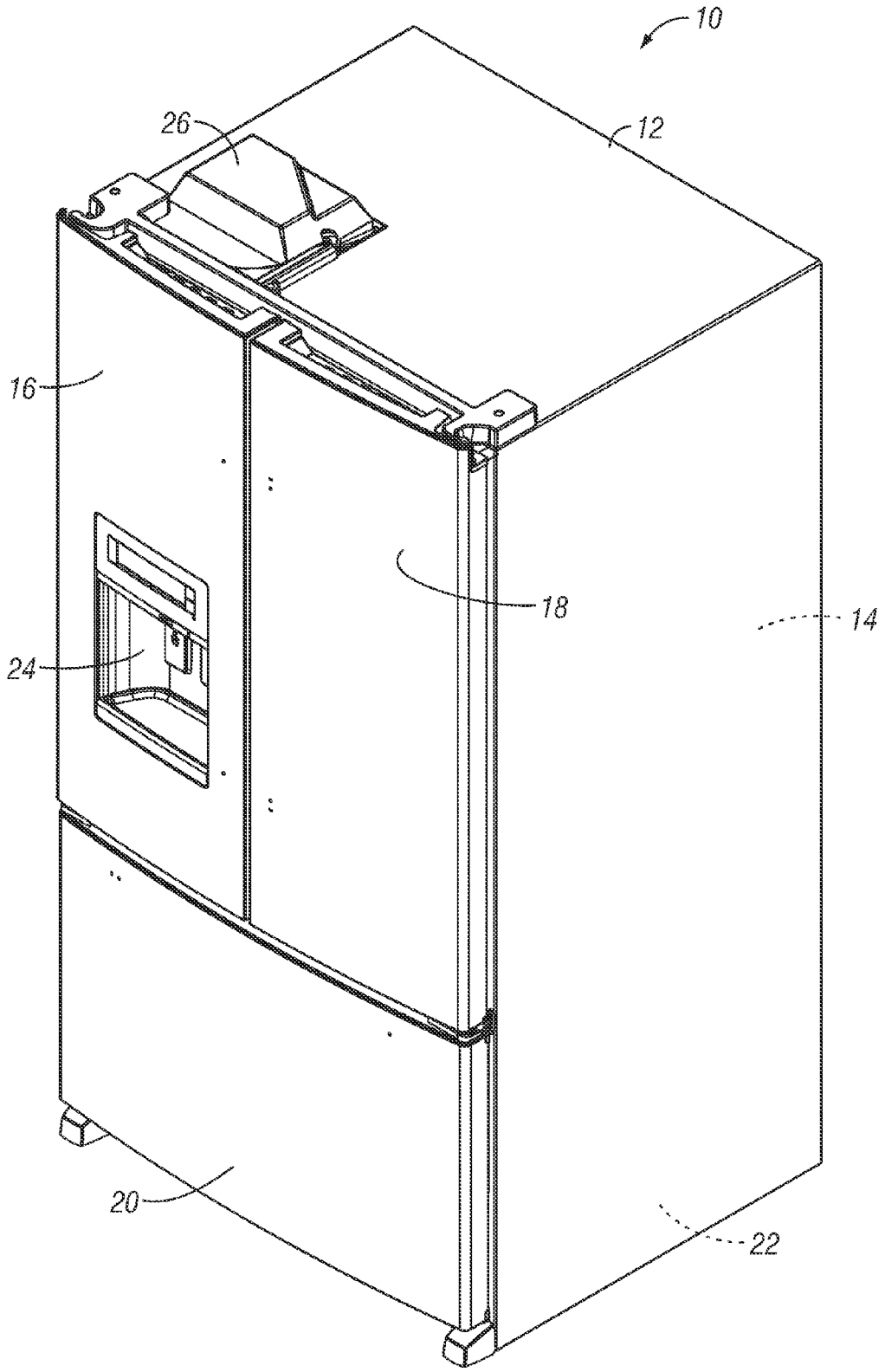
FIG. 1 is a perspective view of a refrigerator.

FIG. 1 is a perspective view of one embodiment of a refrigerator 10. The refrigerator 10 shown is in a bottom mount freezer with French door configuration with left and right fresh food compartment doors 16, 18. The refrigerator 10 has refrigerator housing or insulated cabinet 12. A freezer compartment door 20 provides access to a freezer compartment 22. Fresh food compartment doors 16 and 18 provide access to a fresh food compartment 14. A water and ice dispenser 24 is shown on the fresh compartment door 16. An ice making unit 26 is positioned proximate the upper portion of the fresh food compartment door 16.

Figure 2:
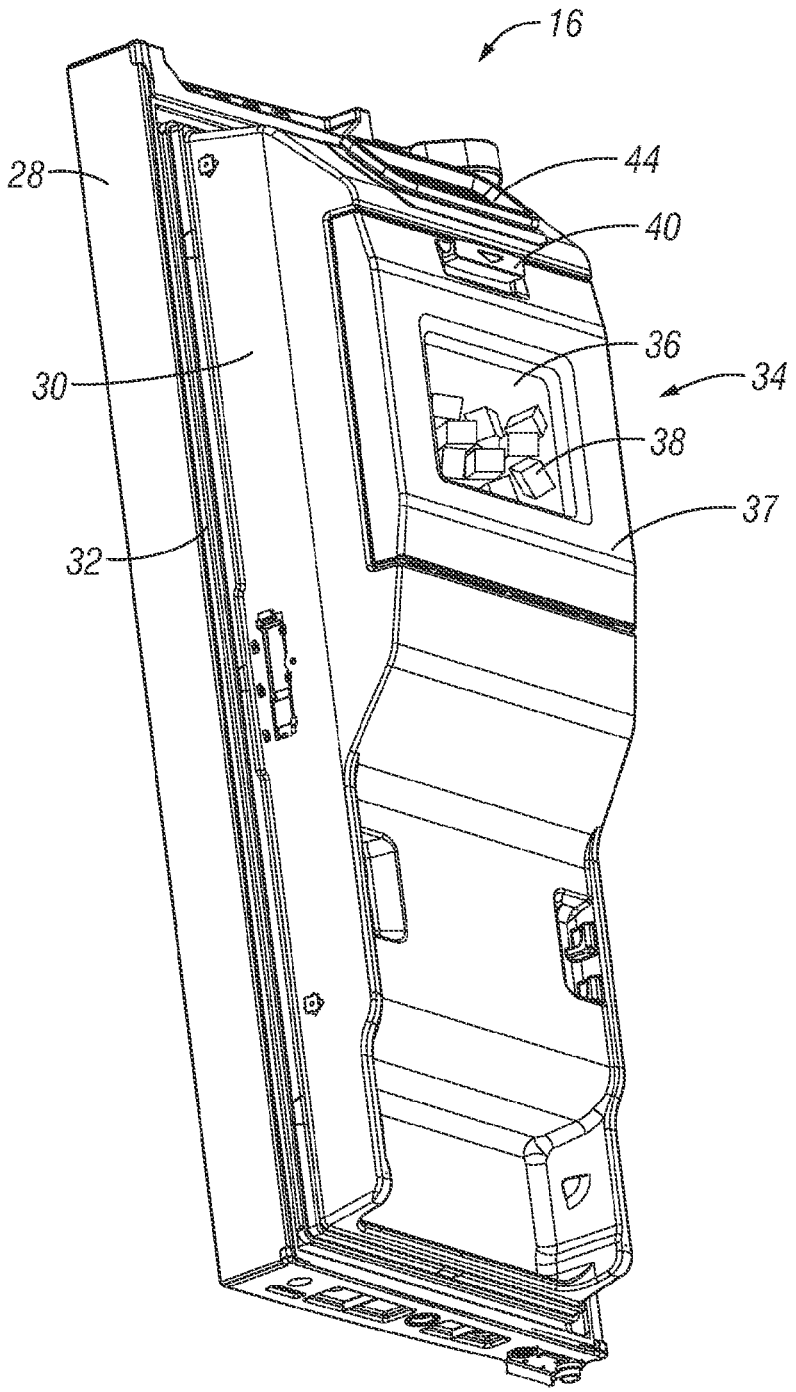
FIG. 2 is an isometric view of an ice storage bucket closed within a refrigerator door.
Figure 3:
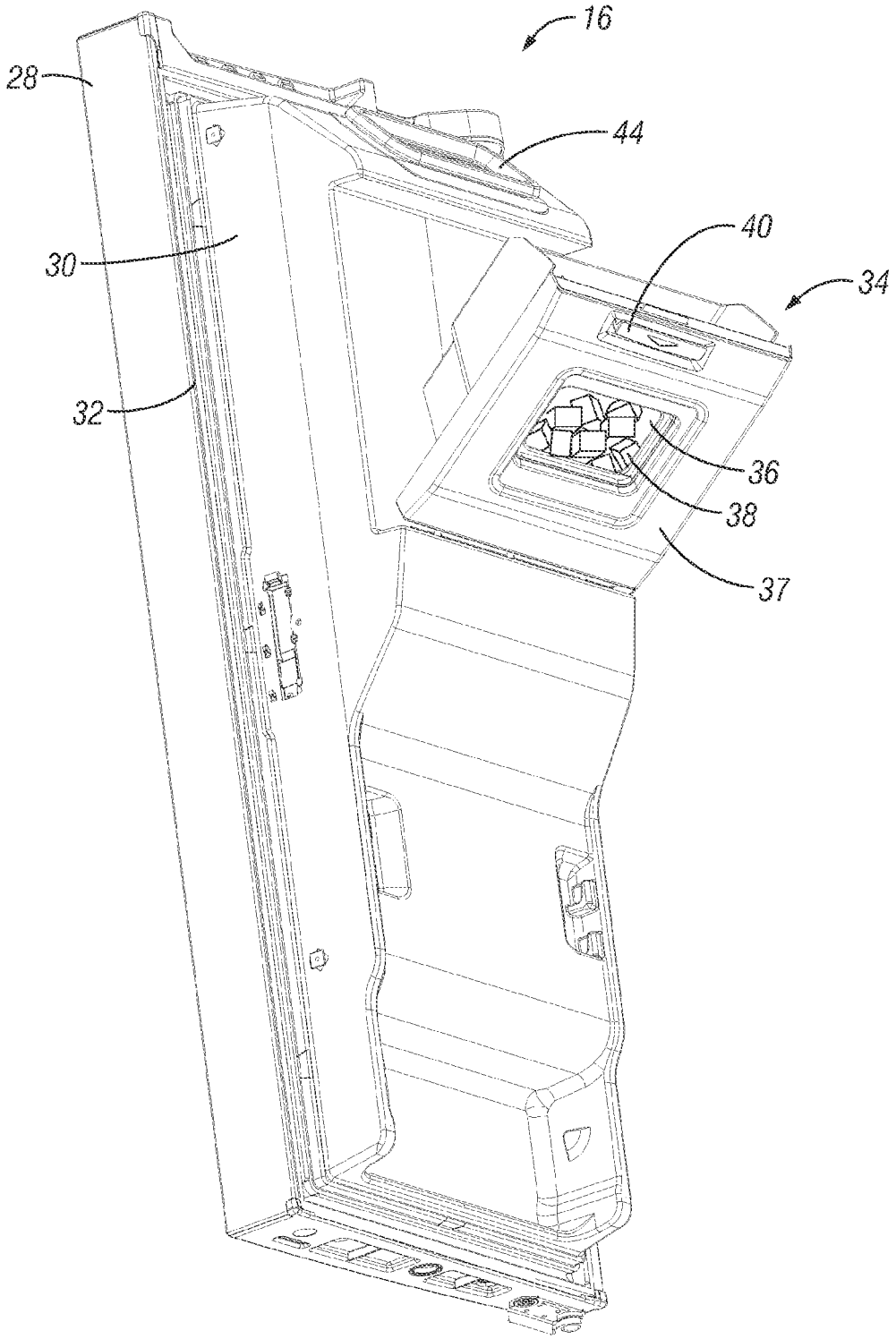
FIG. 3 is an isometric view of an ice storage bucket opened within a refrigerator door.

FIG. 2 illustrates the ice storage bucket 34 in position on door 16. The refrigerator door 16 has an exterior surface 28 and an interior surface 30. The interior surface 30 and the exterior surface 28 are isolated by door seal 32. The ice pieces 36 which can be viewed through window 38 are deposited into ice storage bucket 34 via ice chute 44. The ice pieces 36 are isolated from the fresh food compartment 14 by the ice storage bucket exterior wall 37 which is insulated. The ice storage bucket 34 is in the closed position. As shown in FIG. 3, the ice storage bucket 34 is in the tilt-out position. The present invention allows for an ice storage bucket 34 which is operatively connected to a fresh food compartment door 16 to be conveniently accessed, such as by allowing the ice storage bucket 34 to be tilted open and/or removed.

Figure 4:
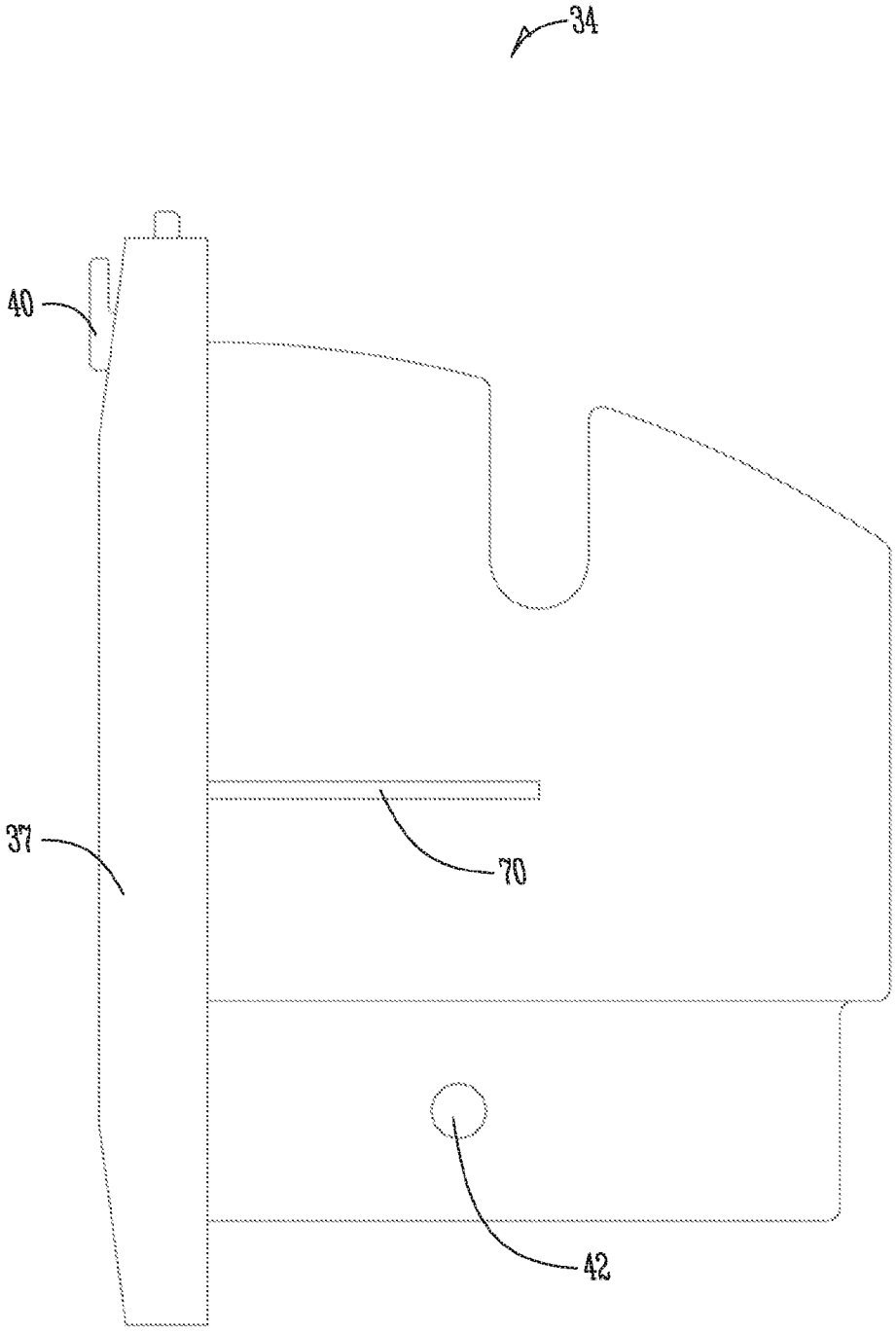
FIG. 4 is a right side view of the ice storage bucket.

The ice bucket 34 has two cylindrical protrusions 42 (the left side protrusion is not shown), as shown in FIG. 4. The two cylindrical protrusions 42 serve as points of fixation and rotation for the ice storage bucket 34. The cylindrical protrusions 42 allow the ice storage bucket 24 to be tilted and rotated out from its ice harvesting positioning. The horizontal support 70, one each for the left and right side will stop and support the ice storage bucket 34 in the ice harvesting position. Latch 40 secures the ice storage bucket in the ice harvesting position.

Figure 5:
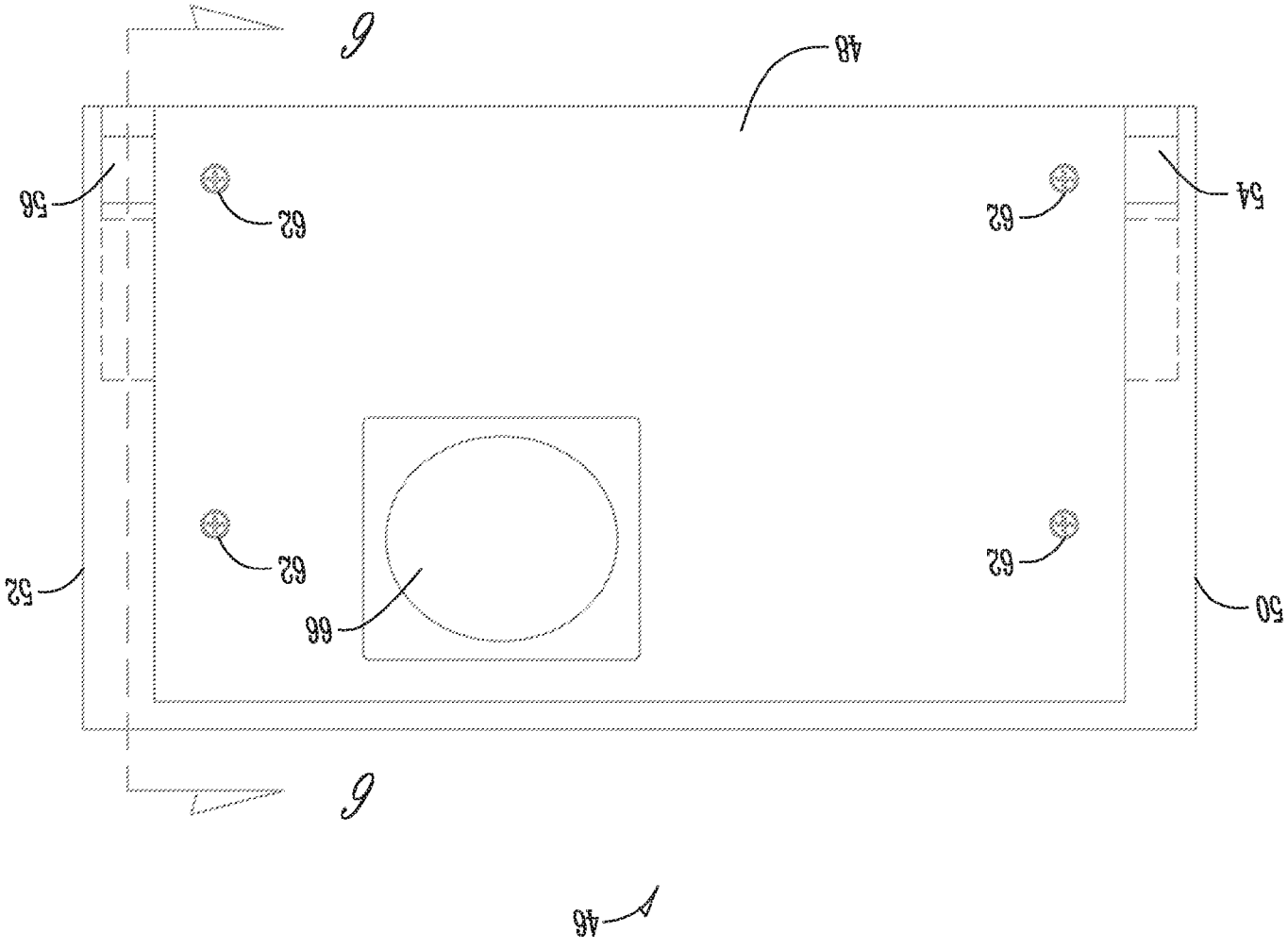
FIG. 5 is a top view of the ice storage bucket mounting plate.
Figure 6:
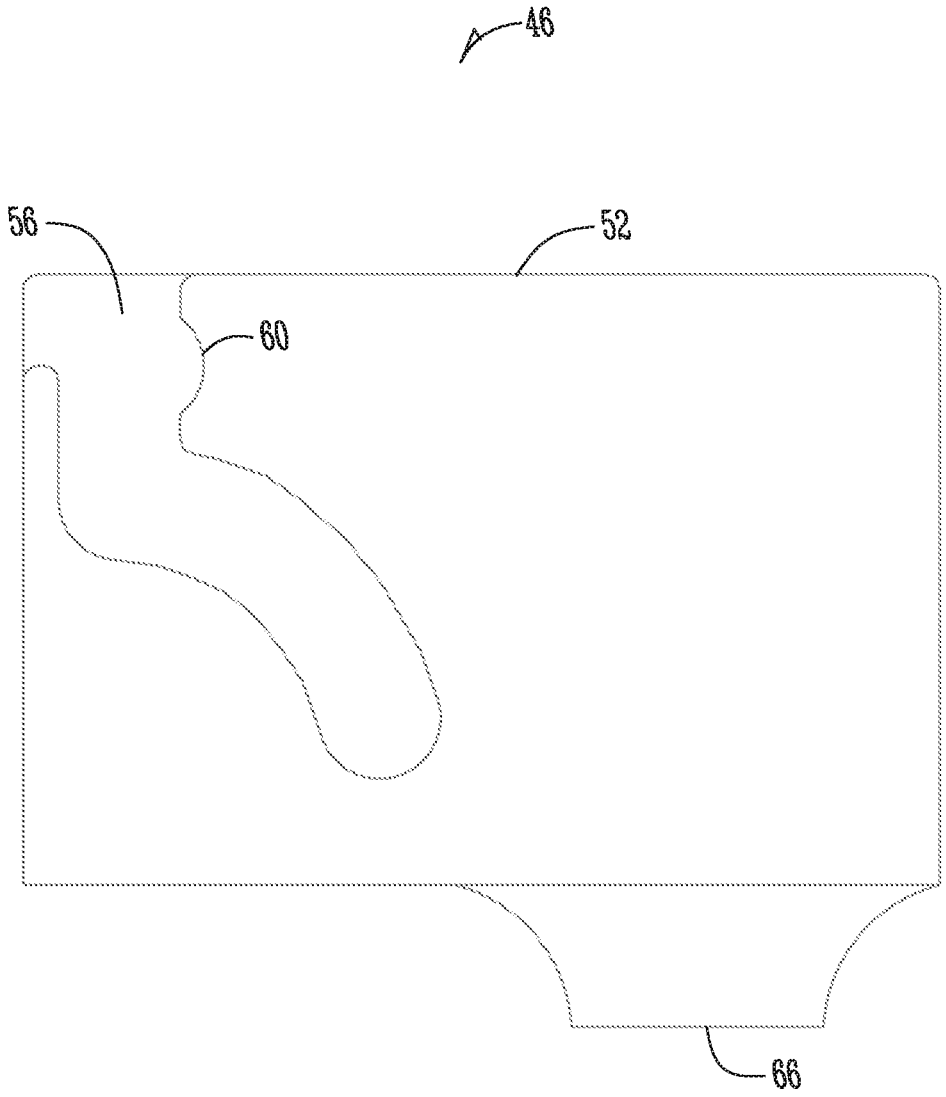
FIG. 6 is a right side view of the ice level storage bucket mounting plate.

FIG. 5 illustrates the ice bucket 34 mounting plate 46. The ice storage bucket mounting plate 46 has a base 48 and a left sidewall 50 and a right sidewall 52. The mounting plate 46 is screwed with four screws 62 into a housing (not shown), which is foamed into the door 16. Left sidewall 50 has a guide member 54 and right sidewall 52 has a guide member 56 which cylindrical protrusion 42 fits into. Also, the ice dispenser chute 66 can be seen from this top view. As shown in FIG. 6, right sidewall 52 has a hemispherical indentation 60 near the top of guide track 56.

Figure 7:
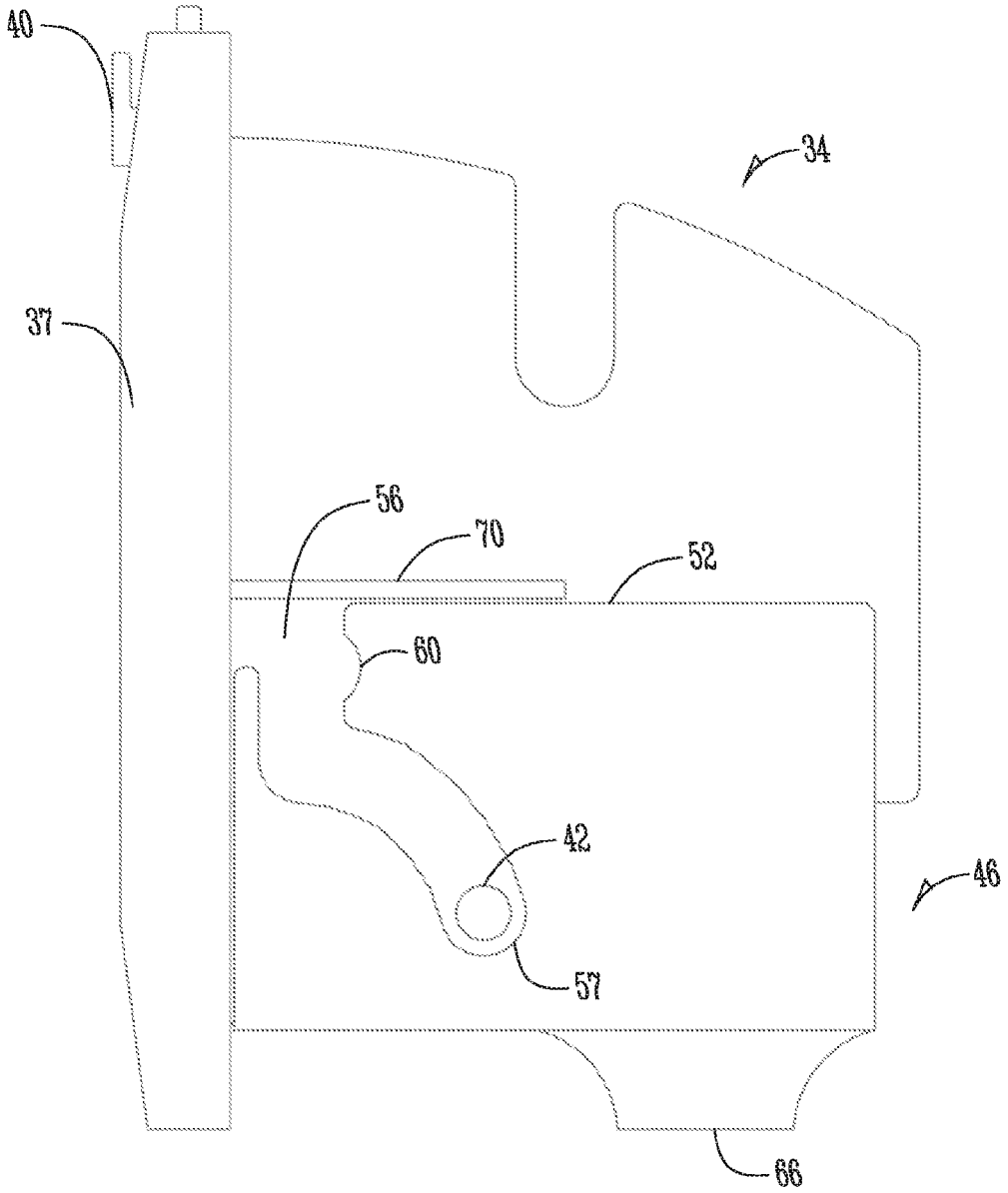
FIG. 7 is a right side view showing the ice storage bucket in the closed position relative to the ice storage bucket mounting plate.

FIG. 7 illustrates the ice storage bucket 34 in the ice collecting and automated ice harvesting position within the mounting plate 46. To allow the ice storage bucket 34 to be in the ice collecting and automated ice harvesting position, cylindrical protrusion 42 may slide along channels, tracks or other guide tracks 56 to its endpoint 57. The combination of horizontal support 70 mating with top of sidewall 52 and latch 40 being latched secures the ice storage bucket 34 in the ice collecting and automated ice harvesting position.

Figure 8:
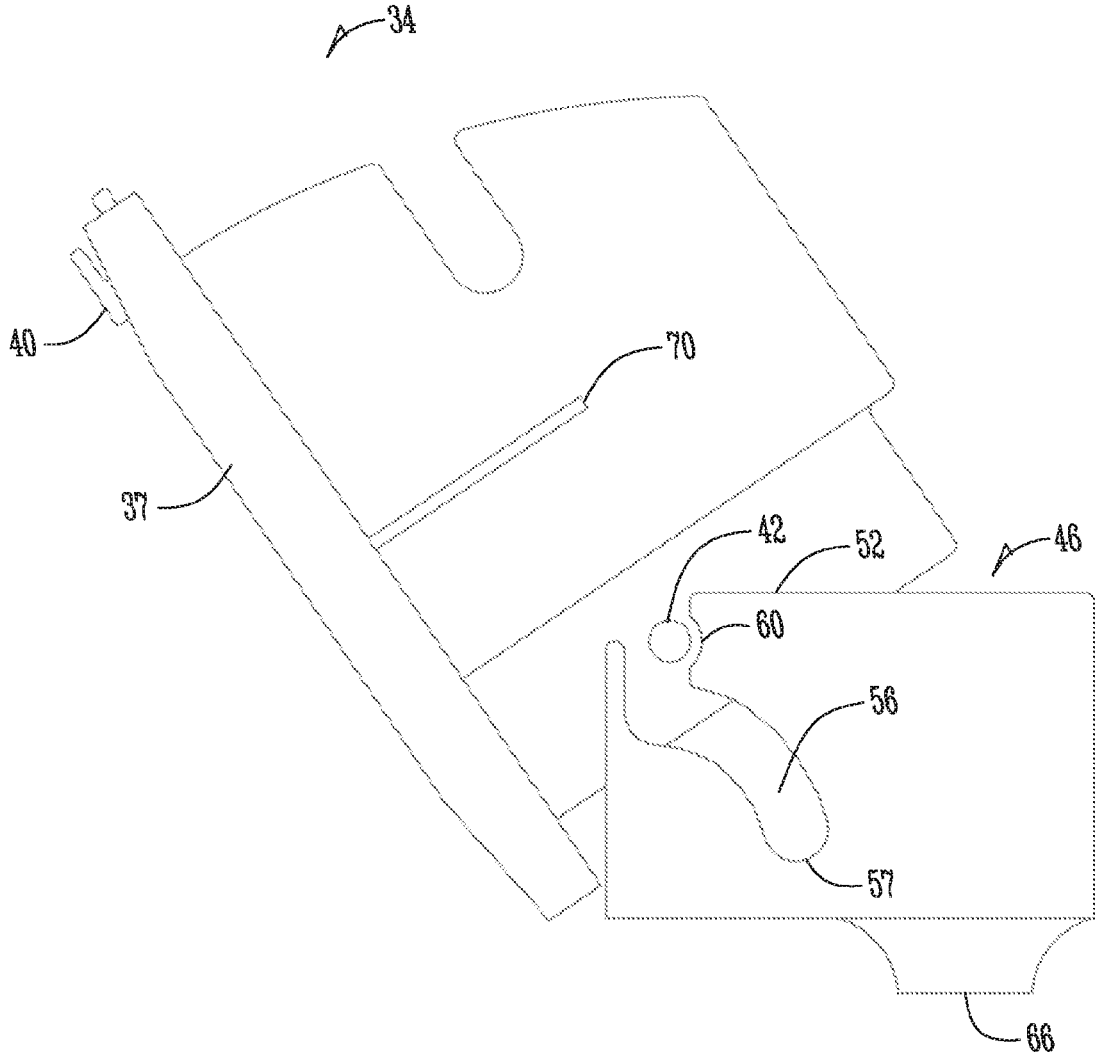
FIG. 8 is a right side view showing the ice storage bucket in an opened position relative to the ice storage bucket mounting plate.

As shown in FIG. 8, ice storage bucket 34 is tilted out to allow access to ice pieces 36 for manual ice harvesting. To tilt ice storage bucket 34, latch 40 is depressed and the ice storage bucket 34 is pulled up and away from mounting plate 46. This motion will cause cylindrical protrusion 42 to slide along guide member 56. Cylindrical protrusion 42 will naturally come to rest at hemispherical indentation 60 and allows the ice storage bucket 34 to remain tilted for manual ice harvesting.

The invention has been shown and described above, and it is understood that many modifications, substitutions, and additions may be made which are within the intended spirit and scope of the invention. For example, the present invention contemplates variations in the configuration of the refrigerator, the shape of the guide members where used, the degree of tilt of the ice storage bucket, and other variations, options, and alternatives. These and other variations, options, and alternatives may be used with the present invention.

What is claimed is:

1. A refrigerator, comprising:

a refrigerator housing;

at least one compartment disposed within the refrigerator housing;

a door for providing access to one or more of the at least one compartments;

an ice storage bucket placed beneath an ice chute for receiving ice from an ice making unit remote from the door into the door, the ice storage bucket configured for collecting and storing ice when in an ice harvesting position; wherein the ice storage bucket includes an open top end and an opposite bottom surface with an insulated exterior wall with a window therein;

a first and a second cylindrical protrusion proximate the bottom surface of the ice storage bucket and on opposite sides of the ice storage bucket;

a mounting plate beneath the ice storage bucket, the mounting plate operatively connected to the door and having opposite side walls, each of the side walls having a top end and an opposite bottom end;

a first guide member and a second guide member in the opposite side walls of the mounting plate, each of the guide members being a slot having a lower closed end and an upper open end at the top end of the side wall, the lower closed end and the upper open end spaced apart by front and back track portions, the guide member having an arcuate portion beginning at the lower closed end, the arcuate portion extending upwardly from the lower closed end towards a vertical portion, the vertical portion extending upwardly from the arcuate portion to the upper top end of the side wall, the vertical portion having the front and back track portions;

wherein each of the guide members is configured to receive one of the cylindrical protrusions and guide the movement of the ice storage bucket between the ice harvesting position at the lower closed end and an ice bucket removal position at the upper open end;

a first and a second hemispherical indentation associated with the first guide member and the second guide member of the mounting plate for mating with the first and the second cylindrical protrusions, each of the hemispherical indentations located along the back track portion of the vertical portion of the guide member between the upper open end and the lower closed end of the guide member and proximate the top end of the side wall, the front track portion of each vertical portion terminating proximate the upper top end of the side wall opposite the hemispherical indentation;

wherein mating of the first and second hemispherical indentations with the cylindrical protrusions occurs at an intermediate position between the ice harvesting position and ice bucket removal position;

a first and a second horizontal support on opposite sides of the ice storage bucket, each of the horizontal supports configured for mating with the top end of the side wall of the mounting plate when the ice storage bucket is in the ice harvesting position.

2. The refrigerator of claim 1 wherein the ice storage bucket is mounted at the door.

3. The refrigerator of claim 1 wherein the at least one compartment includes a fresh food compartment and wherein the door is a fresh food compartment door.

4. The refrigerator of claim 1 wherein the door is a French door providing access to a refrigeration compartment.

5. The refrigerator of claim 4 wherein a freezer compartment is disposed below the refrigeration compartment.

6. A refrigerator, comprising:

a refrigerator housing;

a fresh food compartment disposed within the housing;

a freezer compartment disposed within the housing;

a fresh food compartment door for providing access to the fresh food compartment;

a mounting plate at the fresh food compartment door, having opposite side walls;

an ice storage bucket for collecting and storing ice, having an insulated front wall with a window therein;

an ice chute for receiving ice from an ice making unit into the ice storage bucket when the ice storage bucket is mounted at the mounting plate at the fresh food compartment door;

wherein the ice storage bucket includes an open top end and an opposite bottom surface;

a first and a second cylindrical protrusion proximate the bottom surface of the ice storage bucket on opposite sides of the ice storage bucket;

a first guide member and a second guide member in the opposite side walls of the mounting plate and configured to receive the first and the second cylindrical protrusions;

wherein the guide members have an upper open entrance point at a top surface of the mounting plate and a lower closed end point near the bottom surface of the mounting plate and wherein the guide members have opposing front and back vertical portions extending downwardly from the upper open entrance point, and opposing arcuate portions extending from the opposing front and back vertical portions to the lower closed end point;

a first and a second hemispherical indentation in the opposing back vertical portions within the first and the second guide members of the mounting plate for mating with the first and the second cylindrical protrusions;

wherein the first and the second cylindrical protrusions assist in fixation and rotation of the ice storage bucket relative to the mounting plate;

wherein the first and second hemispherical indentations are at an intermediate position between the upper open entrance point at the top surface of the mounting plate and the lower closed end point near the bottom surface of the mounting plate, the intermediate position located along the vertical portion of the guide member and extending inwardly;

wherein the ice storage bucket rests in an open, tilted position when the cylindrical protrusions mate with the hemispherical indentation;

a first and a second horizontal support on opposite sides of the ice storage bucket, each of the horizontal supports configured for mating with the top end of the side wall of the mounting plate when the ice storage bucket is in the open, tilted position.

7. The refrigerator of claim 6 wherein the freezer compartment is positioned below the fresh food compartment.

8. The refrigerator of claim 6 wherein the ice storage bucket is insulated from the fresh food compartment.

* * * * *